United States Patent [19]

Fischer

[11] Patent Number: 4,601,244

[45] Date of Patent: Jul. 22, 1986

[54] OPERATING SYSTEM FOR RAILROAD HOPPER CAR GATE ASSEMBLY DOORS

[75] Inventor: Robert T. Fischer, Homewood, Ill.

[73] Assignee: Miner Enterprises, Inc., Geneva, Ill.

[21] Appl. No.: 751,902

[22] Filed: Jul. 5, 1985

[51] Int. Cl.[4] ..... B61D 7/18; B61D 7/26; B61D 7/28

[52] U.S. Cl. ..... 105/240; 105/253; 105/290; 105/299; 74/522; 403/330

[58] Field of Search ..... 105/288–290, 105/299, 306, 253, 284, 286, 240; 403/321–323, 330; 74/522

[56] References Cited

U.S. PATENT DOCUMENTS 4,508,037 4/1985 Rousseau ..... 105/290
4,542,701 9/1985 Fischer et al. ..... 105/289 X

FOREIGN PATENT DOCUMENTS 0613930 7/1978 U.S.S.R. ..... 105/286

*Primary Examiner*—Robert B. Reeves
*Assistant Examiner*—Scott H. Werny

[57] ABSTRACT

A railroad car with a hopper-type body may include a series of gate assemblies for selective discharge of commodity in the car body. Each gate assembly may have two pairs of doors which rotate to close or open respective outlet openings in the gate assembly. Door rotation is effected by an operating system comprising an air cylinder joined to a series of lever activating devices by a series of connecting rods. Each lever device includes a lever arm pinned to the connecting rods and rotatively carried on a shaft attached to a sill of the car. A crank arm of the device is also carried on the shaft and interacts with the lever arm through a pair of bolts threaded one each to the lever arm and crank arm. Ends of the device crank arms are pivotally secured by connecting bars to adjacent gate door pairs respectively. Relative angular position of each device lever arm and crank arm may be adjusted by selective positioning of the bolts to locate the crank arm in a position where the door pairs remain properly closed, for example, when the air cylinder is not pressurized. To open the gate door pairs the air cylinder is pressurized to move the connecting rods and rotate the lever arms and crank arms of each lever activating device. Crank arm rotation in turn applies a force evenly to the gate door pairs to open same. Door closure is effected by an oppositely applied force.

9 Claims, 7 Drawing Figures

OPERATING SYSTEM FOR RAILROAD HOPPER CAR GATE ASSEMBLY DOORS

BACKGROUND OF THE INVENTION

1. Field of Invention

This invention relates to operating systems for railroad car gate assembly doors and more particularly to a system which allows ready adjustment to promote proper gate door pair closing and locking and utilizes forces to open or close the gate door pairs which minimize system wear.

2. Prior Art

Mechanical systems to open and close the doors of gate assemblies forming part of hopper-type railroad cars are well known. The system configuration to a large extent is determined by the type of movement required to open and close the doors. For example, U.S. Pat. No. 4,454,822 discloses a system where individual gate doors are slid between an open and closed position by manual rotation of a bar.

Where the doors are hinged respectively to the gate assemblies, a system as set forth in U.S. Pat. No. 4,508,037 may be used to effect movement of all the doors at one time. In this case pairs of opposing doors of adjacent gate assemblies connect with a crank. The crank is equispaced between the gate assemblies but offset with respect to the doors of each pair. The crank is carried on a square shaft rotatively attached to a sill of the car. Also carried on this square shaft within the sill is a member which through a pair of bolts interacts with blocks secured to a pair of arms. The arms in turn are carried by bearings on the square shaft positioned on each side of the member. Ends of the arms are connected to an air cylinder by a series of connecting rods. The angular position of each crank may be adjusted by selective positioning of the bolts which rotates the member and square shaft accordingly. Selective pressurizing of the air cylinder opens or closes the gate doors.

SUMMARY OF THE INVENTION

An operating system of this invention to open and close door pairs hinged to gate assemblies of a hoppper-type railroad car includes a series of lever activating devices. Each device has a lever arm which is joined to an air cylinder by a series of connecting rods. The lever arm of each device is carried on a shaft attached to a sill of the car. Each device further includes a crank arm also carried by the shaft. The crank arm and lever arm operatively interact through a pair of downward projecting bolts secured one each to the lever arm and crank arm. These pair of bolts allow adjustment to the relative angular position of the crank arm with respect to the lever arm. Connecting bars pivotally join ends or an end of the crank arm as the case may be to adjacent gate door pairs or pair.

To open the gate door pairs the air cylinder is pressurized to move the connecting rods and in turn rotate the lever arms of the lever activating devices. This rotative action of the device lever arms results in a like rotation of the device crank arms which swing the connected gate door pairs to an open position. To close the gate door pairs the air cylinder is oppositely pressurized. When the door pairs are closed, the device crank arms are rotated to an over-center position to inhibit inadvertent door movement when the air cylinder is not pressurized.

The gate door operating system of this invention provides several advantages over other like known systems.

First, the system lever activating devices, the connecting rods and connecting bars are positioned under and at least partially within the car sill regardless of the sill configuration, i.e. a standard AAR or Weirton-type sill. Thus, the sill protects these system components from the severe environment often associated with car travel.

A second advantage is the readily accessible location of the lever activating device adjusting bolts. With the gate doors closed, these bolts are positioned vertically with a hex head end of each bolt below the sill. Because of manufacturing dimensional variations and lost motion associated with mechanically joined components, adjustment after assembly is required to place the crank arm of each lever device in an optimun over-center position. This position insures that the respective door pairs are locked closed while at the same time stresses on the system components are minimized.

A third important advantage is that this system is quite simple and thus inexpensive to manufacture. This simplicity also enhances preventive maintenance and part replacement as may be required.

Lastly, by linear aligning the system components, forces transmitted by the components during operation of the door pairs do not enhance wear of these same components. This alignment minimizes torsional stressing. For example, the force applied to the door pairs is evenly distributed between the doors of each pair. Thus, there is no twisting of the doors which after time could distort the fit of a door over its respective gate assembly outlet opening.

DESCRIPTION OF THE PREFERRED EMBODIMENT

Figure 1:
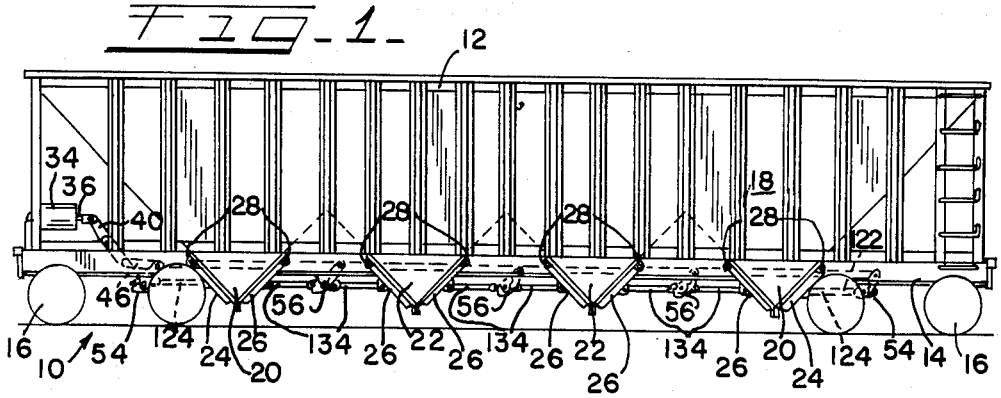
FIG. 1 is a side elevation view of a hopper-type railroad car having gate assemblies connected to an operating system of this invention to open and close pairs of doors of the gate assemblies.

A hopper-type railroad car is shown generally in FIG. 1 and designated 10. The car 10 has a body portion 12 attached to a sill 14 which extends longitudinally and is carried on spaced trucks 16. A lower portion 18 of the car body 12 is formed with a series of gate assemblies with two end assemblies designated 20 and intermediate assemblies 22. It should be understood that the assemblies 20,22 are substantially the same in construction.

Figure 2:
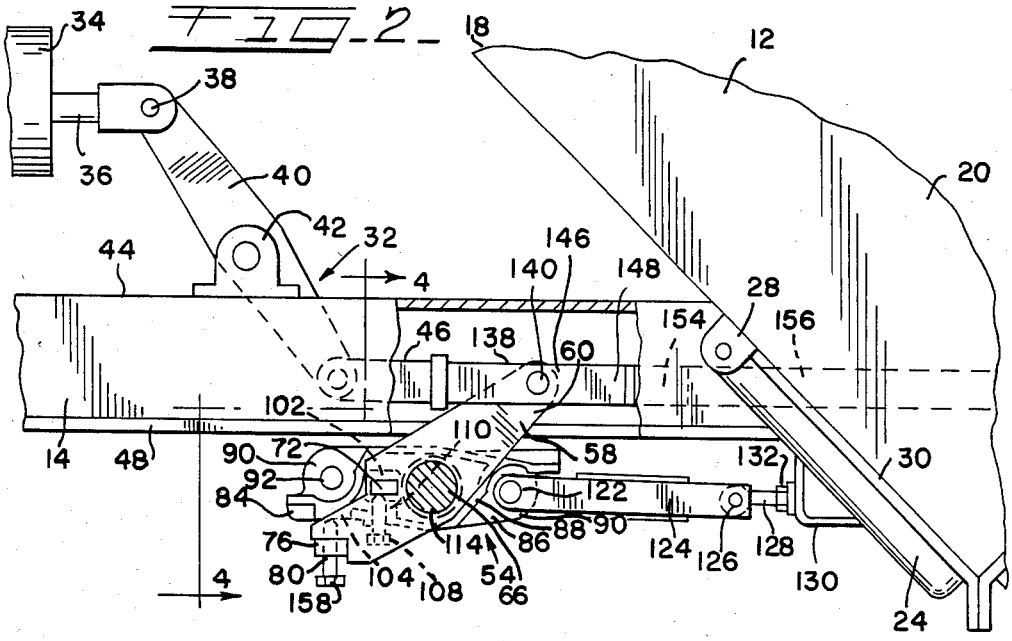
FIG. 2 is a detailed side elevation view of a portion of the operating system of FIG. 1 showing an end lever activating device of the system connected to a gate door pair of an end gate assembly.

Each gate assembly 20,22 has two pairs of doors. End facing doors of the two end assemblies 20 are designated 24; the remaining door pairs are designated 26. Each door of the door pairs 24,26 is hinged respectively to the gate assemblies 20,22 at 28. The door pairs 24,26 may rotate between a closed position over respective outlet openings 30 in the gate assemblies 20,22 as seen in FIGS. 1 and 2 or rotated to an open position (not shown).

To open and close the door pairs 24,26 the car 10 has a gate door operating system 32. The operating system 32 includes an air cylinder 34 attached to the car body 12 above the sill 14 adjacent to one of the trucks 16. A piston rod 36 of the air cylinder 34 extends inward to pivotally connect at 38 with one end of an operating lever 40. A middle portion of the lever 40 is journalled in a set of bearing blocks 42 attached to a top wall 44 of the sill 14. An opposite end of the lever 40 extends through a slotted opening in the sill top wall 44 to pivotally connect with an end connecting rod 46.

Figures 4, 5, 6, 7:
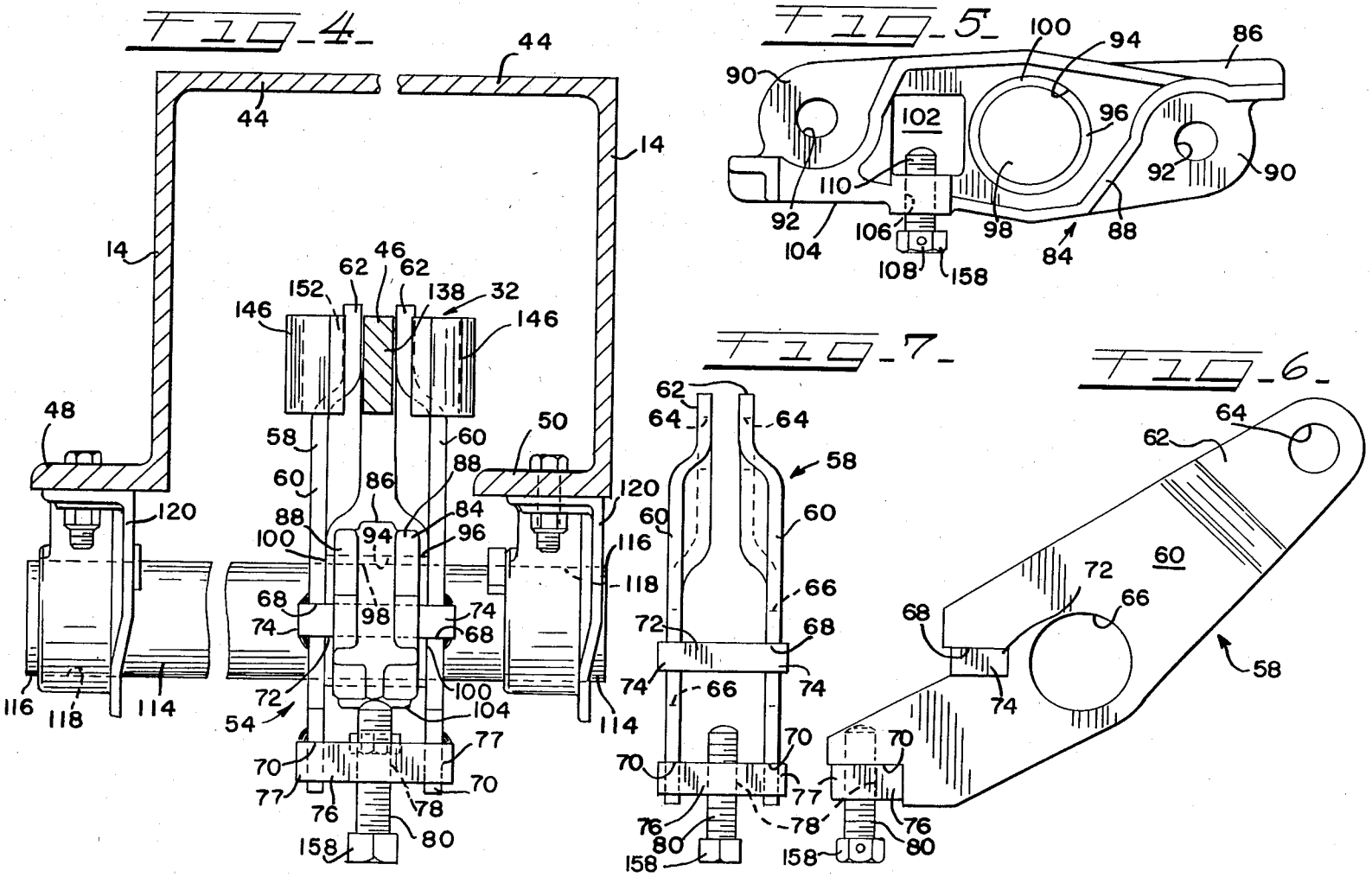
FIG. 4 is a cross section view as seen generally along the line 4—4 of FIG. 2.
FIG. 5 is a detailed side elevation view of a crank arm of the lever device.
FIG. 6 is a detailed side elevation view of a lever arm of the lever device.
FIG. 7 is an end elevation view of the lever arm of FIG. 6.

As best understood by viewing FIG. 4, the sill 14 may have a standard AAR (Association of American Railroads) configuration with its bottom flanges 48 projecting outward or have a Weirton configuration with its bottom flanges 50 projecting inward. A left hand portion of the sill 14 of FIG. 4 shows the former while the right hand portion shows the latter configuration.

A door operating system 32 further includes a series of activating lever devices. The lever devices connecting with the end door pairs 24 are designated 54, and the lever devices connecting with the remaining door pairs 26 are designated 56. Each lever device 54,56 is substantially the same in construction and, therefore, only the device 54 is discussed in detail. The lever device 54 has a lever arm portion 58 defined by two spaced apart plates 60 (see FIGS. 6,7). The plates 60 have inward formed end segments 62 with respective apertures 64 in alignment. In a middle portion of each plate 60 is an enlarged circular opening 66 and slot 68 positioned to align with each other. In an opposite end of each plate 60 is a recess 70. These recesses 70 also align. The lever arm plates 60 are maintained in their spaced relationship by an intermediate bar 72 having its ends 74 affixed in the arm plate slots 68 and an end bar 76 having its ends 77 affixed in the arm plate recesses 70. The end bar 76 is formed with a threaded aperture 78 for an end bolt 80.

The activating lever device 54 further includes a crank arm 84 shown in detail in FIG. 5. The crank arm 84 has a central web portion 86 with ribs 88 extending outward respectively from each side of the web portion 86. The ribs 88 have a like irregular configuration which define in part a pair of pivot areas 90 positioned one each at ends of the crank arm 84. In each pivot area 90 is an aperture 92. Spaced between the apertures 92 in a middle of the crank arm web portion 86 is an enlarged opening 94. Positioned in this opening 94 is a sleeve 96 having an inner circular passageway 98. End surfaces 100 of the sleeve 96 are located the same distance on each side of the web portion 86. Adjacent to the sleeve opening 94 in the web portion 86 is a rectangular-like shaped opening 102 defined in part by a thickened segment 104 of the ribs 88. This segment 104 extends to define in part the adjacent pivot area 90. This rib segment 104 also is formed with a threaded aperture 106 aligned with the opening 102 for an intermediate bolt 108. A threaded end 110 of this intermediate bolt 108 may be selectively positioned in the opening 102.

The crank arm 84 is positioned between the lever arm plates 60 such that the sleeve end surfaces 100 loosely abut the lever arm plates 60 with the sleeve inner passageway 98 aligning with the plate openings 66. The lever arm intermediate bar 72 in turn fits loosely in the crank arm opening 102, and the lever arm end bolt 80 aligns with the crank arm thickened rib segment 104 adjacent to the pivot area 90.

As best understood by again viewing FIG. 4, a round shaft 114 is disposed through the lever arm plate openings 66 and the crank arm sleeve inner passageway 98. In one embodiment of the lever activating device 54 the shaft 114 is fixed to the lever arm plates 60. Alternately, the lever arm 58 and crank arm 84 are free to rotate on the shaft 114. Ends 116 of the shafts 114 are carried in complementarily formed openings 118 in brackets 120 attached to the sill bottom flanges 48 or 50. In the second noted embodiment the brackets 120 include a set screw (not shown) to engage the shaft 114 and inhibit shaft movement.

As seen in FIGS. 1 and 2, ends 122 of end connecting bars 124 are joined one each to the end lever device crank arm pivot areas 90 located adjacent to its respective end gate door pair 24. An opposite end 126 of each connecting bar 124 includes a pinned, threaded rod 128 which in turn is secured to an angle 130 at a point equidistant between the doors of each door pairs 24. This rod-angle connection is enhanced by a nut 132 on the rod 128 which engages the angle 130. The angle 130 is positioned below and across the sill 14 and is attached to the doors of each door pair 24. Again referring to FIGS. 1 and 5, pivot areas 90 of the crank arms 84 of the other lever devices 56 in a similar manner are joined respectively to further connecting bars 134. In this latter case these further connecting bars 134 are secured to opposing door pairs 26 of adjacent gate assemblies 20,22.

Figure 3:
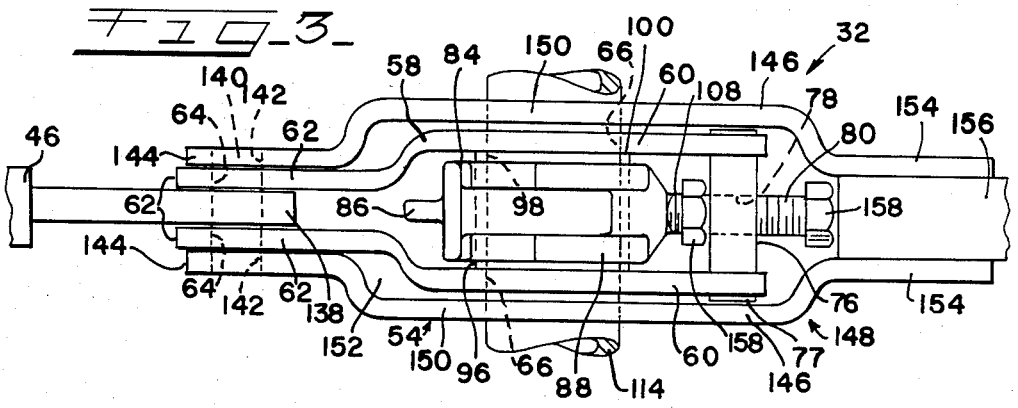
FIG. 3 is a top view of the lever device of FIG. 2. As shown, the device has been operated to open the gate door pair.

As discussed briefly above, the operating lever 40 connects with one end of the end connecting rod 46. An opposite end 138 of the end connecting rod 46 is pivotally secured between the end segments 62 of the lever arm plates 60 by a pin 140 positioned in plate apertures 64. This pin 140 also is positioned in further apertures 142 in outer portions 144 of a pair of link plates 146 forming part of a coupling 148. Each coupling link plate 146 has a central offset section 150 defining a space 152 therebetween for the lever activating device 54. Opposite outer portions 154 of the coupling link plates 146 connect with another connecting rod 156 only shown in part in FIG. 3. While not shown, it should be understood that other like connecting rods 156 join in a similar manner with like couplings 148 which in turn joins the other lever activating devices 54,56. Thus, all the gate door pairs 24,26 are operatively linked to the air cylinder 34.

To minimize manufacturing costs it is most desirable to make all like components of the operating system 32 to the same specified dimensions. Because forces of high magnitude are required to activate the operating system 32 to open or close the gate door pairs 24 and 26, these components have substantial mass. As such, they cannot be readily made to tight dimensional tolerances. Thus, the actual size of these various components may vary as much as $+/-\frac{1}{8}$ inch.

During initial assembly templates are used to promote equispacing of the gate assemblies 20,22 and likewise positioning of the lever activating devices 56 between adjacent gate assemblies 20,22 and the end lever devices 54 the same distance from their respective end gate assemblies 20. With the piston rod 36 of the air cylinder 34 fully retracted, the operating lever 40, various connecting rods, for example rods 46 and 156, are joined to the various lever arms 58 of the lever activating devices 54,56. As connected, the lever arms 58 place the respective device crank arms 84 of each device 54,56 in a substantially horizontal position so that the gate door pairs 24,26 cover their respective gate outlet openings 30.

To insure that the door pairs 24,26 remain closed regardless of the exact position of the various components when the air cylinder 34 is not pressurized, the crank arms 84 of lever devices 54,56 are located in a slightly over-center position. As seen in FIG. 2, an over-center position is effected when a center of the crank arm pivot area aperture and the end 122 of the connecting bar 124 are positioned slightly below a center of the shaft 114. This over-centering inhibits counterclockwise rotation of the crank arm 84 in that some force is required to bend the connecting bar 124 for the crank arm 84 to rotate in the counterclockwise direction. On the other hand, clockwise rotation of the device crank arm 84 is inhibited by the fully retracted piston rod 36. However, because of lost motion and dimensional variations the device crank arms 84 initially are not always in the correct over-center position when the piston rod 36 is fully retracted.

To place the crank arm 84 of each lever device 54,56 in an optimum over-center position, the bolts 108,80 first are screwed outward to disengage from contact with the lever arm intermediate bar 72 and crank arm rib thickened segment 104. The crank arm 84 then may be rotated to an over-center position where the door pairs 24,26 fit tightly over the gate outlet openings 30, the system components are not over-stressed and the air cylinder piston rod 36 is fully retracted. The size of the crank arm opening 102 in relation to the size of the lever arm bar 72 allows relative angular movement between the crank arm 84 and lever arm 58 of the activating devices 54,56 of about 16 degrees. To set the position of the crank arm 84 with respect to the lever arm 58, the bolts 80,108 then are advanced or retracted to reengage the crank arm rib thickened segment 104 and lever arm intermediate bar 72 respectively. Note that with the device crank arm 84 positioned horizontally, hex head ends 158 of the bolts 80,108 project downward from the sill 14 and are thus readily accessible.

To open the gate door pairs 24, 26 the air cylinder 34 is pressurized to drive the piston rod 36 outward and rotate the operating lever 40 clockwise as seen in FIG. 2. This rotation moves the end and other connecting rods 46,156 to rotate the lever arms 58 of the lever activating devices 54,56 counterclockwise. Through the bolts 80,108 lever arm rotation in turn rotates the crank arm 84 counterclockwise to swing the gate door pairs 24,26 open. To close the gate door pairs 24,26 the air cylinder 34 is oppositely pressurized. Note that because the system components are linearly aligned, a transfer of the opening or closing force through these components does not produce wear enhancing torsional or bending stress.

While this invention has been shown and described, it should be understood that the invention is not limited thereto except by the scope of the claims. Various modifications and changes can be made without departing from the scope and spirit of the invention as the same will be understood by those skilled in the art.

What I claim is:

1. An operating system for gate assembly doors of a hopper-type railroad car, said system comprising a lever activating device including:

a lever arm rotatively carried on a shaft attached to a sill of said car with one end of said arm centrally located in said sill to connect with means to effect operation of said system, a crank arm rotatively carried by said shaft between plates in part defining said lever arm with ends of said crank arm to connect with pairs of doors of adjacent gate assemblies at a point midway between doors of said door pairs, an intermediate bar having ends attached to said lever arm plates and extending through an opening in said crank arm to engage an intermediate bolt threadedly secured to said crank arm, and an outer bar attached to opposite ends of said lever arm plates with an outer bolt threadedly secured to said outer bar to engage said crank arm, wherein a relative position of said gate door pair with respect to said operation means may be regulated by adjusting a position of said bolts to relocate said crank arm with respect to said lever arm on said shaft.

2. In an operating system to open and close door pairs of gate assemblies of a hopper-type railroad car with said system including a lever activating device, an improvement of said device comprising:

a crank arm having ends prepared respectively to connect pivotally with an adjacent door pair of said gate assembly, a centrally positioned aperture in a web portion of said crank arm for a sleeve having an inner passageway, an enlarged opening formed in said web portion positioned next to said sleeve, a thickened segment forming part of ribs connecting with sides of said web portion respectively, and an intermediate bolt secured in a threaded aperture in said rib thickened segment with an end of said bolt extending into said enlarged opening,.

a lever arm defined by a pair of plates spaced apart by an intermediate bar having respective ends affixed in a slot formed adjacent to a circular opening in each said plate, an outer bar having respective ends affixed in a recess formed in one end of each said plate with an opposite end of each said plate prepared to connect with operative means of said system, and an outer bolt threadedly secured in an aperture in said outer bar, and said crank arm positioned between said lever arm plates with a shaft carried by a sill of said car disposed in said plate apertures and said crank arm sleeve passageway to align said crank arm with said operative means and a point substantially equispaced between doors of said gate door pair, and said intermediate bar positioned through said crank arm enlarged opening to interact with said intermediate bolt and said outer bolt positioned to interact with said crank arm thickened segment, wherein a relative angular position of said crank arm may be adjusted by selective positioning of said bolts to regulate an operative distance between said operative means and said gate door pair.

3. An operating system as defined by claim 2 and further characterized by, said enlarged opening in said crank arm being of a size to loosely accommodate said lever arm intermediate bar, wherein said relative angular position of said crank arm with respect to said lever arm may be adjusted approximately 16 degrees on said shaft.

4. An operating system as defined by claim 2 and further characterized by, said shaft carried by inward extending bottom flanges of said sill with said lever activating device positioned between said sill flanges.

5. An operating system as defined by claim 2 and further characterized by, end surfaces for said crank arm sleeve loosely abutting said lever arm plates, wherein said crank arm sleeve end surfaces maintain said crank arm centered between said lever arm plates.

6. An operating system as defined by claim 2 and further characterized by including, brackets attached to said sill to rotatively carry ends of said shaft with said lever arm plates being attached to said shaft, wherein rotational movement of said lever arm results in like movement of said shaft.

7. An operative system to open and close door pairs of spaced apart gate assemblies formed as part of a lower portion of a body of a hopper-type railroad car, said system comprising:

operative means attached to an end of said car body to provide a force to open or close said gate door pairs, an operating lever pivotally attached to a top wall of a sill of said car with said lever having one end pivotally attached to said operative means and an opposite end positioned within said sill, a series of connecting rods joined to form pivot joints therebetween with an end connecting rod attached to said operating lever opposite end, a series of lever activating devices positioned respectively adjacent to said gate door pairs, each said device including a lever arm having an end positioned within said sill to connect with one said connecting rod pivot joint with said lever arm rotatively carried on a shaft attached to bottom flanges of said sill, a crank arm rotatively carried on said shaft between plates in part defining said lever arm with said crank arm aligned with said operative means, an intermediate bar carried by said lever arm plates adjacent to said shaft and extending through an opening in said crank arm to engage an intermediate bolt threadedly secured to said crank arm and an outer bar carried by opposite ends of said lever arm plates with an outer bolt threadedly secured to said outer bar to engage said crank arm, and a series of connecting bars with one each of said bars pivotally joining an end of said device crank arm to an adjacent angle attached to said adjacent door pair at a midpoint between said doors, wherein with said door pairs in a closed position over outlet openings in said gate assemblies said operative means may be activated to rotate said operating lever and in turn move said connecting rods within said sill, said connecting rod movement rotating said lever arms of said lever activating devices to interact said crank arm with said bolts and rotate said crank arm to draw said connection bars toward said repective lever device and swing said door pairs to an open position and release commodity in said car body, and with said car body in an empty condition said operative means may be oppositely activated to swing said gate door pairs closed with a position of each said lever device crank arm being selectively located by said bolts in an over-center position to inhibit door pair movement with said operative means in a non-activated state.

8. An operative system as defined by claim 7 and further characterized by, hex head ends of said bolts extending downward from said lever device to a point below said sill bottom flanges, wherein said bolts are readily accessible to adjust a relative angular position of said crank arm with respect to said lever arm on said shaft.

9. An operative system as defined by claim 7 and further characterized by, said sill bottom flanges extending inward with said series of lever activating devices carried by said shafts between said sill flanges.

* * * * *